US010720026B2

(12) United States Patent
Gupta et al.

(10) Patent No.: US 10,720,026 B2
(45) Date of Patent: Jul. 21, 2020

(54) SKILL-BASED WAGERING METHODS, DEVICES AND SYSTEMS

(71) Applicant: Bet On Yourself Gaming, LLC, Las Vegas, NV (US)

(72) Inventors: Sameer Mohan Gupta, Los Angeles, CA (US); Ofir Ventura, Las Vegas, NV (US); Seth Schorr, Las Vegas, NV (US)

(73) Assignee: Bet On Yourself Gaming, LLC, Las Vegas, NV (US)

( * ) Notice: Subject to any disclaimer, the term of this patent is extended or adjusted under 35 U.S.C. 154(b) by 0 days.

(21) Appl. No.: 16/293,947

(22) Filed: Mar. 6, 2019

(65) Prior Publication Data

US 2019/0197837 A1 Jun. 27, 2019

Related U.S. Application Data

(63) Continuation of application No. 15/983,424, filed on May 18, 2018, now Pat. No. 10,262,503.

(60) Provisional application No. 62/509,305, filed on May 22, 2017.

(51) Int. Cl.
*G07F 17/32* (2006.01)

(52) U.S. Cl.
CPC ..... *G07F 17/3295* (2013.01); *G07F 17/3223* (2013.01); *G07F 17/3239* (2013.01)

(58) Field of Classification Search
CPC ..... G07F 17/3295
See application file for complete search history.

(56) References Cited

U.S. PATENT DOCUMENTS

| | | | | |
|---|---|---|---|---|
| 4,856,787 | A * | 8/1989 | Itkis | G07F 17/32 273/237 |
| 6,050,895 | A | 4/2000 | Luciano, Jr. et al. | |
| 8,864,572 | B2 | 10/2014 | Oberberger | |
| 9,251,657 | B2 | 2/2016 | Arnone et al. | |
| 9,251,666 | B2 | 2/2016 | Oberberger | |
| 2008/0153570 | A1* | 6/2008 | Esses | G07F 17/3244 463/20 |
| 2010/0022289 | A1 | 1/2010 | Menicou | |
| 2013/0084930 | A1 | 4/2013 | Chang et al. | |
| 2013/0273990 | A1* | 10/2013 | Oberberger | G07F 17/32 463/13 |
| 2017/0124812 | A1 | 5/2017 | Washington et al. | |
| 2019/0151739 | A1 | 5/2019 | Belsky | |

* cited by examiner

*Primary Examiner* — Omkar A Deodhar
(74) *Attorney, Agent, or Firm* — Weide & Miller, Ltd.

(57) ABSTRACT

Embodiments of the invention comprise skill-based wagering games, systems and devices. In one embodiment of the invention, the configuration of a skill-based game is dependent upon the skill level of the player or players. In one embodiment, the game is configured so that the odds of winning the game, and thus the payout for a winning outcome, depends upon the player's skill level. In other embodiments, the payouts or awards offered to players are fixed and the difficultly level for achieving a winning outcome is adjusted based upon the skill levels of the players.

20 Claims, 4 Drawing Sheets

SKILL-BASED WAGERING METHODS, DEVICES AND SYSTEMS

RELATED APPLICATION DATA

This application is a continuation of U.S. application Ser. No. 15/983,424, filed May 18, 2018, which claims priority to U.S. Provisional Application Ser. No. 62/509,305, filed May 22, 2017, the contents of said prior applications are incorporated by reference as if set forth in their entirety herein.

FIELD OF THE INVENTION

The present invention relates to skill based gaming, and particularly, wager-based gaming.

BACKGROUND OF THE INVENTION

A wide variety of wager-based or "gambling" games are known. These games have various rules and may be presented using a variety of equipment. For example, table games may be presented at a gaming table using equipment such as cards, dice, a roulette wheel or the like. Machine-based games may be presented via rotating reel slot machines, video slot machines, video poker machines and the like.

Gambling games are generally classified into two different types: (1) "chance" games—where the outcome of the game is primary dependent upon chance (even if some skill may be involved), and (2) "skill" games—where the outcome of the game is primarily dependent upon the skill of the player. In the United States, historically only wagering games of chance have been permitted. However, skill-type wagering gaming is a new focus.

There are significant problems confronted when trying to develop wager-based skill games. One problem is configuring the game so that the player has a reasonable opportunity to win their wager (and be awarded winnings), while at the same time offering some predictability of the game being profitable to the game operator.

In the case of "chance" type games, the player does not control the outcome of the event. Thus, the odds of a winning or losing outcome of the event can be more closely controlled to achieve these criteria. For example, in a slot-type game, the symbols on the slot reels and particular winning combinations of symbols then displayed by the slot reels can be carefully selected so that a random spinning of the reels results, on average, in a particular percentage of winning and losing outcomes. Generally, the game is designed so that the percentage of winning outcomes is sufficiently high—at least coupled with the payout for the winning outcomes, to make the game exciting to the player (a game may have a high frequency of winning outcome but then lower average payouts or might couple a lower frequency of winning outcomes with outcomes having higher payouts, in order to make the game exciting to the player).

The payouts for winning outcomes are selected so that, based upon the probabilities of winning and losing outcomes, the average player payback, e.g. the amount of wagers returned to players as winnings for winning outcomes, is less than 100%. In the case of a slot machine, the average payback may be selected to be in the range of 93%-97%. This means that the remaining 3%-7% of all wagers are lost and thus retained by the casino as winnings (often referred to as the house hold). In this scenario, each individual player is enticed to play the slot game because they perceive that they have a reasonable chance of receiving winnings. Yet, over the long term, there are a sufficient number of losing wagers that the house receives revenue associated with the offering of the game.

Video poker games are classified as games of chance, and yet they involve some skill by the player (in selecting cards to hold/discard, for example, from their initially dealt cards). However, winning poker hands can be chosen, along with their associated payout, so that even if a player plays with a perfect game strategy, the player return on wagers will average less than 100%, thus ensuring a house hold for the game operator.

Thus, one problem with skill-based wagering is how to design a skill-based game which offers wagering which is both attractive to the player and the house. In this regard, unlike games of chance, the probability of a player obtaining a winning outcome in a game of skill largely depends upon the player's skill (rather than chance). This has two implications. First, the house then faces different probabilities of winning based upon players having different skill levels. Second, the attractiveness of the game to the player varies depending upon the player's skill.

What is needed are skill-based wagering games, systems and devices which offer individual players and/or groups of players the opportunity for attractive wager-activities having outcomes, and thus associated awards, which are primarily (if not solely) dependent upon the player's skill.

SUMMARY OF THE INVENTION

Embodiments of the invention comprise skill-based wagering games, systems and devices. In one embodiment of the invention, the configuration of a skill-based game is dependent upon the skill level of the player or players. In one embodiment, the game is configured so that the odds of winning the game, and thus the payout for a winning outcome, depends upon the player's skill level. For example, relative to a particular skilled-based event, a player with a high skill level is offered lower winnings for achieving a particular outcome as compared to a player of a low skill level who achieves that same outcome. In other embodiments, the payouts or awards offered to players are fixed and the difficultly level for achieving a winning outcome is adjusted based upon the skill levels of the players.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise skill-based wagering games, systems and devices. In one embodiment of the invention, the configuration of a skill-based game is dependent upon the skill level of the player or players. In one embodiment, the game is configured so that the odds of winning the game, and thus the payout for a winning outcome, depends upon the player's skill level. For example, relative to a particular skilled-based event, a player with a high skill level is offered lower winnings for achieving a particular outcome as compared to a player of a low skill level who achieves that same outcome. In another embodiment, the payouts or awards offered to players are fixed and the difficultly level for achieving a winning outcome is adjusted based upon the skill levels of the players.

Basic Principles of Personalized Skill Based Games of the Invention

Figure 1:
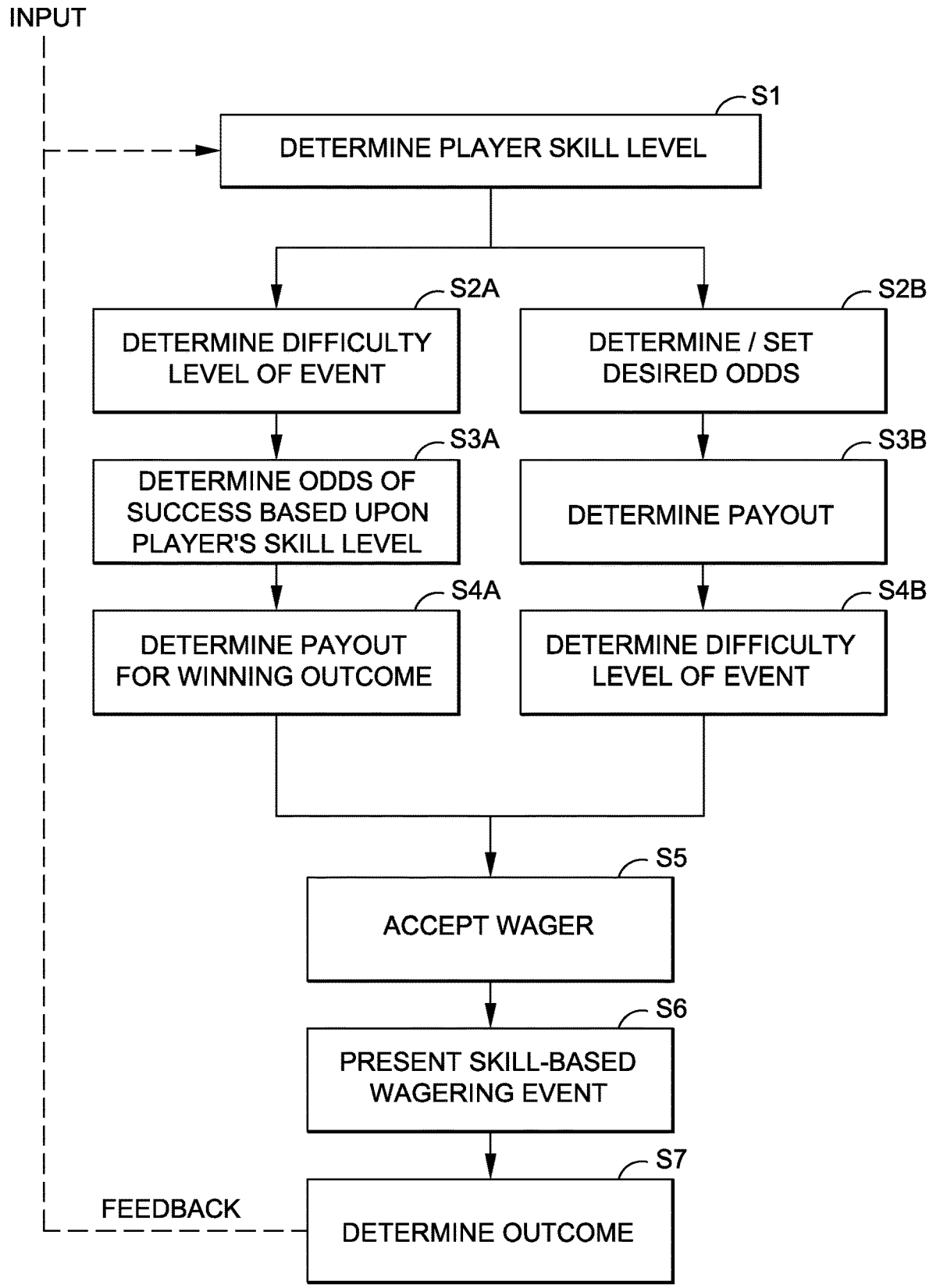
FIG. 1 is a flow diagram of a methodology of the present invention.

FIG. 1 illustrates one principle of operation of the invention. In a step S1, a player's skill level is determined. In one embodiment, as described below, the player's skill level is determined by input to one or more devices or via the use of one or more sensors. For example, as described in more detail below, relative to baseball batting-type wagering event, the player might attempt to hit a real or virtual baseball. The player's success in hitting the ball may be measured or determined. In other embodiments, the player might simply swing a bat and the swing might be analyzed, such as to determine bat speed, etc.

The player's skill level may be measured or determined relative to a presented wagering activity, or it could be determined generally. For example, although the skill-based wagering event might comprise a golfing event, the player's skill level might be estimated or measured by measuring a player's reaction speed to pressing illuminated buttons or the like.

The player's skill level may be represented in various manners. In one embodiment, the skill level might comprise a numerical value on a skill scale, such as on a scale of 1-100 where 1 is the lowest skill and 100 is the highest skill. However, the player's skill level might be correlated to a particular skill activity. For example, it might be determined in step S1 that a player drives a golf ball over 300 yards 9 out of 10 times on average. Thus, relative to a golf event where the goal is to drive a ball 300 yards, the player's skill level might be represented as a percentage, such as 90%.

In a step S2A, a difficulty level for obtaining a winning outcome of the event is determined. In one embodiment, as detailed below, the difficulty level may be represented as a numerical scale value or might be represented in other manners. As one example, a skill-based gaming event might comprise a player attempting to putt a golf ball across a surface into a hole. If the distance to the hole is 3 feet, for example, the level might be 5, whereas if the distance to the hole is 6 feet, the level might be 7. Of course, the level of difficulty may encompass various factors, such as the event in question, weather, surfaces, equipment, etc.

In a step S3A, the odds for the player achieving a winning outcome of the skill-based event area determined based upon the player's skill level relative to the difficulty of the event. Most importantly, these odds are player-specific, in that they vary depending upon the particular skill level of the player at issue. In other words, if a Player A has a skill level of 10 and Player B has a skill level of 5, then as to the same event, Player A may be deemed to be twice as likely to achieve a winning outcome as Player B.

Of course, the odds or probabilities of success/failure (based upon the player's skill as referenced to the difficulty of achieving a winning outcome) may be determined in various manners. In one embodiment, the odds or probabilities may be determined, for example, via an algorithm.

In a step S4A, a payout is determined for a winning outcome of the skill-based event as to the player. In one embodiment, the payout is determined based upon the determined odds. For example, if the determined odds are 100% that the player will achieve a winning outcome, then the player may be offered a payout of only their wager (or their wager less a rake, commission or vigorish to the house)—since offering the player more than their wager means that the house will have to payout winnings to a player and have no expectation of winnings.

In one embodiment, higher winnings may be offered to players who are determined to have lower odds of success. For example, relative to a Player A who places a $100 wager and has a 75% chance of success, that player might be offered a payout of $125 (e.g. a return of their $100 wager and $25 in winnings) for a successful outcome. Player B who has a 50% chance of success might be offered a payout of $150 for a successful outcome.

As illustrated in FIG. 1, in a step S5, the player places their wager if they are amenable to the payout being offered to them (it is noted that the wager could be placed before the above-reference steps or at other times; for example the player could place their wager initially and then withdraw it if the offered payout is too low), and in a step S6, the player participates in the skill-based event (e.g. the event is presented, the player's input(s) is/are received and the outcome of the event is determined which as noted below, may be implemented by one or more gaming machines or systems).

If the player is unsuccessful in the event, e.g. loses, the player preferably loses their wager to the house. If the player is successful in the event, e.g. achieves a winning outcome, the player preferably wins their wager and is paid the defined winnings.

In one embodiment, as illustrated in FIG. 1, the outcome of the event is preferably used in a feedback loop as part of further determining the player's skill level (such as for future events). In other words, the player's skill level may be assessed and then updated or modified over time, such as based at least in part upon the player's participation in one or more skill-based wagering events.

In the above-described configuration, different odds and then different payouts are determined and offered to players of different skill levels as to the same skill-based event. In another embodiment, the same odds and payouts are offered to players of different skill levels, but the difficultly level of the skill-based event is determined based upon, and varies based on, a player's skill level to achieve the desired odds and payouts.

In this configuration, referring to FIG. 1 again, in step S1 each player's skill level is again determined. In a step S2B, desired odds are set or determined. This may be accomplished in various manners, such as by having the player select desired odds (or payouts, as described next) or by having the house select such.

In a step S3B, the payout for a winning outcome of the event is determined or set relative to the odds.

In a step S4B, the difficulty of the skill-based event is then determined so that the desired odds correlate the player's particular skill level relative to the event. As one example, the selected odds might be 50%. Relative to skill-based event in which players putt a golf ball into a hole, Player A might have a skill level of 10 and Player B might have a skill level of 5. Thus, the skill-based event presented to Player A might be one where Player A is required to putt a golf ball into a hole which his 20 feet away (where it is determined that based upon Player A's skill, Player A has a 50-50% chance) and Player B is required to putt a golf ball into a hole which is only 10 feet away (where it is determined that based upon Player B's skill, Player B has the same 50-50% chance of success). In this manner, players of different skill levels can be offered the same odds and thus the same payouts (rather than, for example, different winnings for the same event as described above).

The remaining steps of this embodiment are otherwise the same as those described above.

As one example of the invention, a Player Rating might comprise a value from 1 to 100 and be derived from (as described in more detail herein) player demographic information, a player social graph, a player's past gameplay and a player's performance under similar circumstances (e.g. analogous event performance). Then a Player Multiple (which may be used as a Player Payout Multiple or Player Difficulty Multiple) may be generated, where the Player Multiple may comprise a value of 100/Player Rating. Thus, the Player Multiple comprises a value between 1 and 100 and is inversely related to the Player Rating.

In an embodiment where players participate in the same event, the Player Multiple defines different payouts for players of different skill levels. For example, a player having a Player Rating of 75 (of 100) could be paid a payout multiple of 1.3 times their wager for a winning outcome of the event, whereas a less skilled player having a Player Rating of 50 (of 100) could be paid a payout multiple of 2 times their wager for the same winning outcome.

Likewise, the Player Multiple may define the difficulty of the event when the payout for a winning outcome is the same. For example, the payout on a $10 wager might be set at $20 for an event having a base difficulty level of 10. Then the player with a Player Multiple of 2 would be presented with an event which is 2 times easier (or some scaled value) of the base level, while the player with the Player Multiple of 1.3 would be presented with an event which is only 1.3 times easier than the base difficulty (e.g. the player with the higher rating is presented with a harder event than the player with the lower rating).

The player skill level, Player Rating and Player Multiple are preferably determined by one or more computing devices (such as a game server as detailed below), such as based upon information stored in one or more databases and/or obtained from one or more remote devices such as sensors. The calculated Player Rating and Player Multiple may be used to generate one or more outputs, such as an output from a game server to a gaming device which causes the device to vary the difficulty level of the event or the vary the odds/payouts to the player.

Devices and Systems

The invention as described above may be implemented in various manners. In one preferred embodiment, the invention is machine-implemented or partially machine-implemented.

Figure 2:
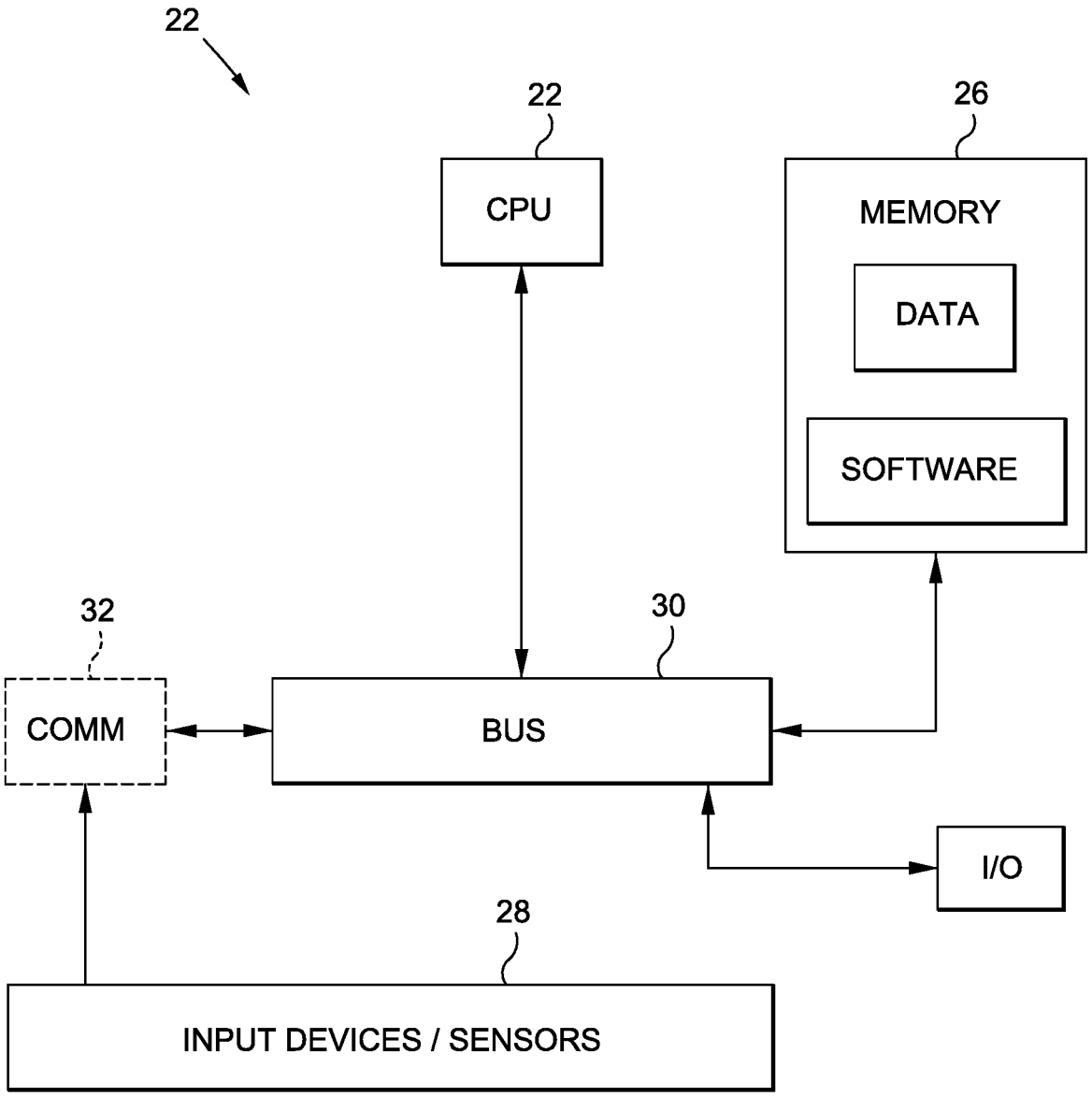
FIG. 2 schematically illustrates a device in accordance with the present invention.

FIG. 2 conceptually illustrates one embodiment of a skill-based gaming device in accordance with the present invention. In general, the device 20 comprises at least one processor or CPU 22, one or more memory or data storage devices 26, and one or more communication interfaces 28. In one embodiment, the processor 22 executes machine-readable code or software which is stored in the memory device 26.

As illustrated, the device 20 includes, or is configured to receive input from, one or more player input devices or sensors 28. In one embodiment, the input devices or sensors 28 are preferably utilized in determining a skill level of the player. The input devices 28 might directly receive input. For example, to judge a player's reaction speed, the input device 28 might comprise a button which lights up. The player may be required to depress the button as quickly as possible after it is illuminated, whereby the input to the button (the button press) receives direct input. In other embodiments, one or more sensors might be used to obtain or gather information about a player's actions. For example, a player might be required to swing a golf club to hit a golf ball. One or more sensors might be used to sense the speed and/or path of the swing of the club and/or the speed/path of the golf ball.

In one embodiment, output or signals from the input devices or sensors 20 are provided to the CPU 22 for processing and/or might be provided to the one or more data storage devices 26 for storage. In another embodiment, the output or signals from the input devices or sensors 20 might be provided to one or more external processors or devices for pre-processing and then be provided to the CPU 22 and/or one or more data storage devices 26.

In one embodiment, the various components of the device 20 might be configured to communicate over one or more communication buses 30. The input devices or sensors 20 might be configured to communicate with the system bus 30 via one or more communication interfaces or ports. For example, the input devices or sensors 20 might be configured as USB devices, or might be configured as Internet devices and provide data in the form of TCP/IP packets.

In one embodiment, the device 20 may include one or more I/O devices. These might comprise, for example, a keyboard, mouse, video display or the like. These I/O devices may allow a user, such as an operator or a player, to interface with the device 20.

The one or more data storage devices 26 may store software which causes the CPU 22 to implement the functionality described above.

Of course, the device of the invention might have any number of configurations, including where elements of the device are distributed, such as by being associated with other devices or systems (distributed, etc.) or linked with other devices or systems.

Figure 3:
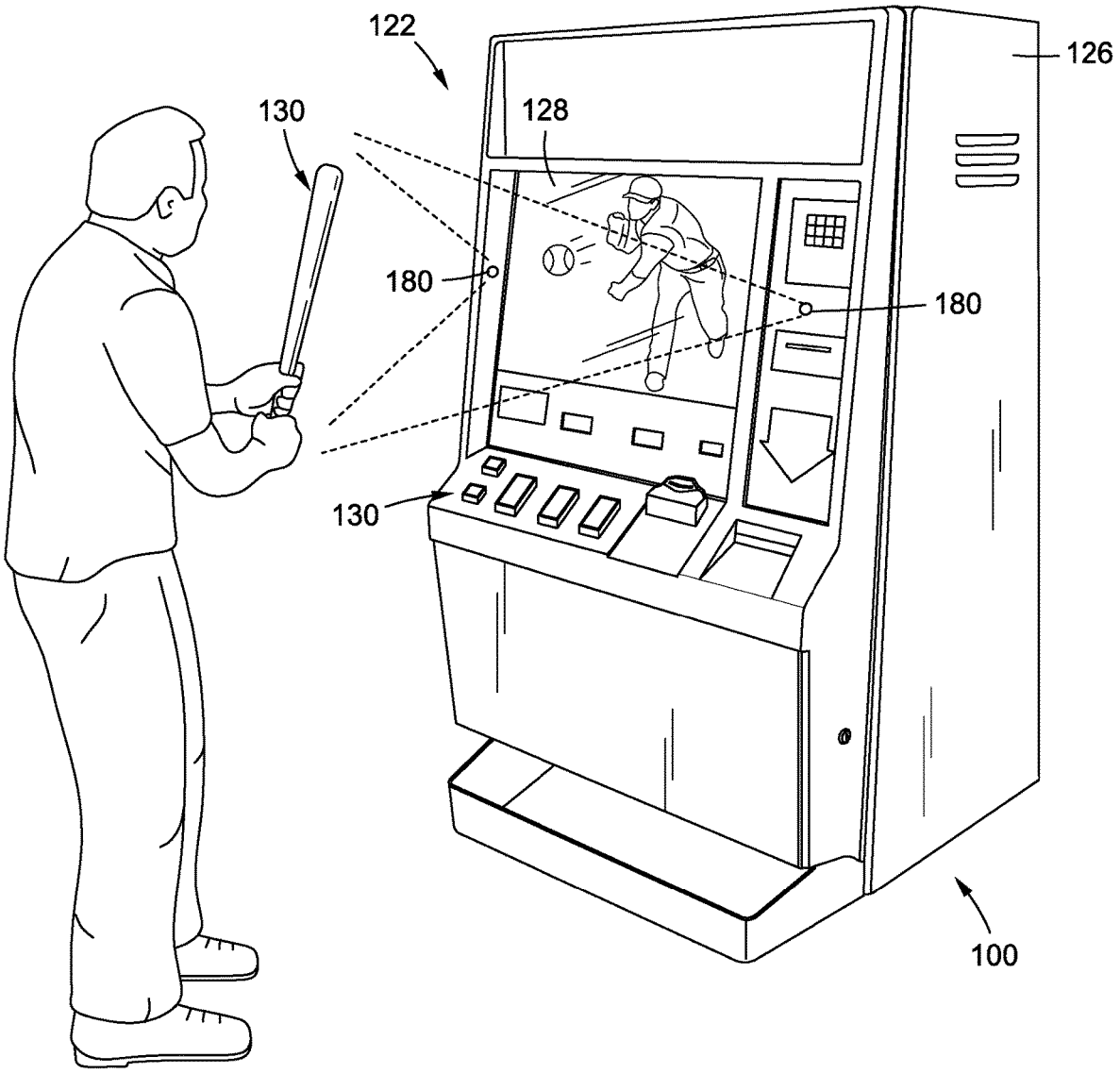
FIG. 3 illustrates a gaming machine in accordance with one embodiment of the invention.

For example, FIG. 3 illustrates one embodiment of a device 20 of the invention configured as a gaming machine 122. The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

As illustrated, the gaming machine 122 generally comprises a housing or cabinet 126 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 122 may vary. In the embodiment illustrated, the gaming machine 122 has an "upright" configuration. However, the gaming machine 122 could have other configurations, shapes or dimensions (such as being of a "slant"-type, "bar-top" or other configuration as is well known to those of skill in the art).

The gaming machine 122 preferably includes at least one display device 28 configured to display game information. The display device 128 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 128 may be capable of projecting or displaying a wide variety of information, including images, symbols and other indicia or information associated with game play, game promotion or other events. The gaming machine 122 might include more than one display device 128, such as two or more displays 128 which are associated with the housing 126. The gaming machine 122 might also include a top box or other portion. Such a top box might include one or more display devices 128, such as in addition to one or more main displays which are associated with the housing 126. Also, the gaming machine 122 might include side displays (such as mounted to the exterior of the housing 126) and might include multiple displays of differing sizes.

As described in more detail below, the gaming machine 122 is preferably configured to present one or more games upon a player making a monetary payment or wager. In this regard, as described in more detail below, the gaming machine 122 includes a mechanism or means for accepting monetary value.

As described above, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 122 preferably includes a mechanism or means for returning unused monetary funds and/or dispensing winnings to a player.

The gaming machine 122 preferably includes one or more player input devices 130 (such as input buttons, plunger mechanisms, a touch-screen display, joystick, touch-pad or the like). These one or more devices 130 may be utilized by the player to facilitate game play, such as by providing input or instruction to the gaming machine 122. For example, such input devices 130 may be utilized by a player to place a wager, cause the gaming machine 122 to initiate a game, to provide skill-based game input, to "cash out" of the gaming machine, or to provide various other inputs.

In one preferred embodiment, the gaming machine 122 includes at least one microprocessor or controller for controlling the gaming machine, including receiving player input and sending output signals for controlling the various components or peripheral devices of the machine 122 (such as generating game information for display by the display 128). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 128, for determining winning or losing game outcomes and for displaying information regarding awards for winning game outcomes, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information, including tracked game play information).

Preferably, the controller is configured to execute machine readable code or instructions (e.g. software) which are configured to implement the game. In this regard, the gaming machine is specially configured to present the game of the invention via specific software and/or hardware which causes the gaming machine to operate uniquely. For example, the controller of the gaming machine 122 may be configured to detect a wager, such as a signal from a player's depressing of the "bet one" button (which may affect the betting of one credit). Upon such an event and/or the player otherwise signaling the gaming machine to present the game, the controller may be configured to cause the at least one display 128 to display unique information, such as a unique graphical interface or unique game display, including game symbols or other game information. The controller may accept input from a player of game inputs via the one or more player input devices of the gaming machine 122. As indicated above, the machine-readable code may be configured in various manners, such as by having various "modules" of software which are designed to implement specific features of the game play or game presentation.

As indicated, the gaming machine 122 is configured to present one or more wagering games. The gaming machines 122 is preferably configured to accept value, such as in the form of coins, tokens, paper currency or other elements or devices representing value such as monetary funds. Thus, as indicated above, the gaming machine 122 preferably includes a mechanism or means for accepting monetary value. For example, the gaming machine 122 might include a coin acceptor 32 for accepting coins. Of course, associated coin reading/verifying devices and coin storage devices may be associated with the gaming machine 122 if it is configured to accept coins. Likewise, the gaming machine 122 might include a media reader 134. Such a reader may be configured to accept and read/verify paper currency and/or other media such as tickets. Of course, in such event the gaming machine 122 may further be configured with one or more paper currency or ticket storage devices, such as cash boxes, and other paper currency or media handling devices (including transport devices).

The gaming machine 122 might also be configured to read FOBs, magnetic stripe cards or other media having data associated therewith and via which value or funds may be associated with the gaming machine 122. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 122 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 122 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 122 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 122 may also include a player tracking device, such as a card reader 166 and associated keypad 170. Such player tracking devices are well known and may permit the game operator to track play of players of the gaming machine. The tracked play may be utilized to offer player bonuses or awards.

A casino may have numerous such gaming machines 122, such as located on a casino floor or in other locations. Of course, such gaming machines 122 might be used in other environments, such as an airport, a bar or tavern or other locations.

Preferably, the gaming machine 122 is configured to generate and present one or more skill-based games as described above. Thus, the one or more input devices 130 are preferably configured to receive a player's skill-based game input to the gaming machine 122. As described herein, various types of input devices or sensors may be used to receive that input (for example, FIG. 3 illustrates a gaming machine 122 which includes buttons and motion detection sensors, such as for detecting a player's swing of a baseball bat).

The gaming machine 122 preferably also includes software for implementing the features of the invention as described herein. For example, the software may include one or more modules that are configured to assess a player's skill, calculate odds and payouts for one or more events, present the event to the player (such as when executed, causing the CPU to cause the display information regarding the skill-based gaming event), receive the player's input (in this example, the game may comprise the display of a virtually pitched baseball which the player attempts to hit by swinging a bat and where sensors 180 are used to register the player's swing, where the CPU then determines the outcome of the event and then, if winning awards winnings).

As described above, in one embodiment, the player's skill level is utilized relative to presentation of the skill-based game. Thus, the gaming machine 122 may be configured to determine, track and/or store information regarding players and their skill levels. For example, a data file may be maintained in the memory of the gaming machine 122, such as which includes a list of players and their skill levels. The gaming machine 122 might identify the player in various fashions, such as by a player tracking card, biometric identification or other information or devices which are now known or later developed (a new player might be required to provide information to generate an account, etc.). A biometric or other method of confirming the player's identity is preferably used, such as to prevent a player of one skill level (such as a high skill level) from signing in as another player (such as a player of a low skill level).

Figure 4:
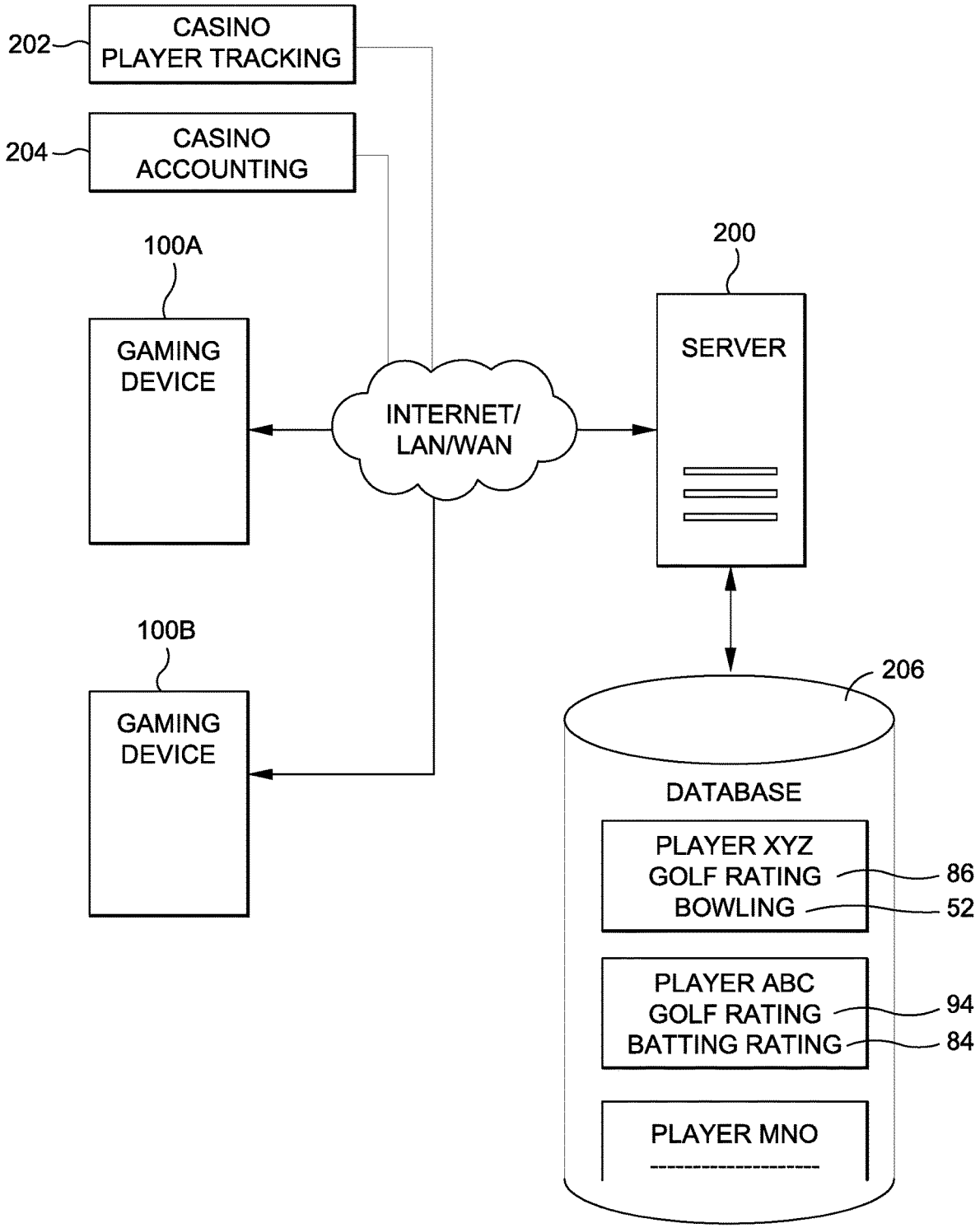
FIG. 4 illustrates one embodiment of a gaming system in accordance with the invention.

Of course, the gaming machine 122 may be configured to generate and present games in a stand-alone manner or it may be in communication with one or more external devices at one or more times. For example, as illustrated in FIG. 4, the gaming machine 122 may be configured as a server based device and obtain information from a remote game server 200 (in which event the gaming machine controller may receive game information from the server and use that server-generated information to present the game at the gaming machine).

For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration, it will be noted that the term "controller" may comprise more than one device. For example, in a server-based environment, a controller at a server may generate game information and transmit that information to a local controller at a gaming machine or a player's computer or other electronic device.

The local controller at the gaming machine or the player's computer or other electronic device may then cause game information to be displayed on one or more associated displays.

The gaming machine 122 may, as noted above, be part of a system which includes other devices. For example, as illustrated in FIG. 4, the gaming machine 122 may communicate with one or more casino systems (such as over one or more networks such as the Internet, LANs, WANs, etc.), such as a player tracking server or system 202, an accounting system or server 204, a ticketing system, a bonusing system, a tournament system, other gaming machines, and external devices.

As one example, a player might sign up for a player rewards account and a casino funding account at the casino. The player might go to a gaming machine 100A to play a skill-based game and might select a particular event at the machine (such as "hit a 100 mph fastball"). The player might insert their player tracking card and PIN into the machine 122, which transmits that information to a player tracking system of the casino. This system identifies the player and notifies the gaming machine 122, which in turn, notifies the server 200. The server 200 looks up the player and determines that they have skill level X. Either the server 200 or gaming machine 122 might then determine the odds and payout for the "hit a 100 mph fastball" game based upon the player's skill level. The player might then place a wager on the event, either via credits or via accessing funds associated with their casino account or a remote bank account, etc. The gaming machine 122 would then present the event, registering the input from the player as noted above. Information regarding the player's input and/or the outcome of the event might be transmitted back to the host server 200 for updating the player's skill level.

In one configuration, as illustrated in FIG. 4, a central database 206 of players and their skill levels may be maintained an updated (such as in a database associated with a central server), which database is utilized relative to a plurality of different gaming machines or devices.

In the embodiment just described, multiple gaming machines or "presentation devices" might be linked to one more servers or back end systems, such as which track players, player skill levels and the like, for the entire system of linked machines.

Of course, a gaming device or system may be configured in various fashions and be configured to present various skill-based gaming events (as described in more detail below). As one example, the skill-based gaming event might comprise a simulated golf event or activity and the gaming machine might comprise, at least in part, a sport or game simulation system such as described in PCT/US2015/055018, entitled SPORT AND GAME SIMULATION SYSTEMS WITH USER-SPECIFIC GUIDANCE AND TRAINING USING A DYNAMIC PLAYING SURFACE, the contents of which is incorporated herein by reference in its entirety as though set forth herein. Such a device might comprise the event presentation device of the invention, wherein the device is modified to include the features herein (e.g. determine and track player skill level, determine odds/payouts, receive wagers, etc.), and/or is linked to other devices or systems for implementing such features. For example, such a system may be used to present golf putting events where player putt a golf ball with a putter across the surface into a hole or at targets, where aspects of the playing surface may vary (such as by tilting it, where the hole location and/or distance can be varied, etc.) and where ending ball position, such as in the hole or hitting a target, or close to the hole/target, may result in a score.

It is noted that other configurations of devices and systems may be utilized to present skill-based games as used herein. For example, in one embodiment, a player might attempt to hit a ball which is pitched with a pitching machine. The pitching machine may be controlled by a processor or the like so as to set, for example, the speed or type of pitch, etc. The player might utilize a bat to try and hit the ball. Sensors associated with the bat, image sensors or the like might monitor the player's input to determine whether the player hit the ball, the output of which is provided back to the processor for determining the outcome of the event.

Additional Aspects of the Invention

Additional features and aspects of the invention will now be described.

First, the types of skill-based gaming events to which the present invention are applicable are limitless. As examples, and not by way of limitation, such might comprise baseball, basketball, football, soccer, golfing, driving/racing, bowling, Skee-ball, video/virtual games (Candy Crush Saga®, Asteroids®, etc.), billiards/pool, card games or other events now known or later developed, or aspects thereof (for example, relative to baseball, the event might comprise pitching to a target or hitting; relative to golf such might comprise putting or driving).

Further, the skill-based gaming event might comprise or require two or more activities. For example, the player might place a wager than they can successfully drive a golf ball 300 yards and putt a golf ball 20 feet into the hole, hit five of ten baseball pitches or the like.

In one embodiment, players might be assigned a single skill level or might have different skill levels, such as relative to different events. For example, a Player A might be assigned a high skill level for golf events, but a low or different skill level for bowling events.

The present invention may apply to as few as one player or multiple players. For example, as detailed above, a single player might place a wager that they will achieve a successful skill-based gaming event outcome and that single player may then participate in the event and the outcome is determined based upon that single player's performance.

However, the present invention may be applied to a group of players, e.g. two or more players, such as where two or more players each engage in one or more activities as part of the skill-based event. As one example, Players A and B may collectively place a $100 wager that Player A can drive a golf ball 300 yards and Player B can putt a golf ball into a hole 20 feet away. In this instance, the skill levels of the players are determined and odds and a payout may be set based upon the skill levels of the players relative to those activities, collectively.

As indicated herein, one aspect of the invention is the determination of the skill level of a player and application of that skill level to a wager-based skill game. As noted herein, the skill level of a player may be determined or accessed in various manners. Preferably, the skill level is determined by one or more physical inputs or actions of the player, either via input to one or more devices or by sensing the player's actions. A wide variety of input devices or sensors may be used to gather the information and the types of physical actions which the player is required to perform may vary, including depending upon the wagering event. For example, in order to access the skill of a player in throwing a baseball, the player may be required to throw a baseball. Whereas, to assess the skill level of the player in putting a golf ball, the player may be required to putt. On the other hand, a player's skill might be determined from other actions or groups of actions. For example, a player might be required to throw a ball at a target, try and hit a pitched baseball and bowl a bowling ball as an assessment of the player's skill level (even as to other events, such as golfing).

Of course, a wide variety of input devices and/or sensors might be used to determine a player's physical inputs. These may include, but are not limited to, accelerometers, motion detecting devices, velocity measuring devices, distance measuring devices, force measuring devices and others.

In some embodiments, the skill level may be determined or set at least partially based upon other factors, such as player age, sex, height, weight, or various other information such as answers to questionnaires, social media information or the like (e.g. answers to questions like "how often do you golf?", etc.). In one embodiment, an operator might view or assess a player or a player's actions and enter information into the gaming device or system for use in setting or determining a player's skill level.

In one embodiment, a player's skill level is at least partially determined by one or more initial attempts at the game (though as indicated above, the skill level might be determined wholly or in part based upon other events or information). As noted below, a player might be assigned an initial base rating and the player's rating might then be adjusted based upon additional information. For example, the player's base rating might be set at the highest level (such as 100 on a scale of 100) to minimize the risk to game operator. Based upon additional information which suggests that the player doesn't truly have a skill level of 100, the player's skill level may be adjusted downwardly. As one example, relative to a putting event in which a player attempts 3 flat putts, 2 putts with a 3 degree right-to-left break and then 1 putt with a 6 degree right-to-left break, the player's skill level might be adjusted after the entire event, or after each individual putt—and then the odds/payout for the event may be similarly adjusted. In one embodiment, a player might place a wager on the entire event and then the odds may be applied to the entire event, or in another embodiment the player might be required to place a wager on each putt/event and where the odds and associated payouts may thus vary based upon the adjusted player skill level after each putt (for example, the odds/payouts on the first 3 putts might be better than average while the odds/payouts on the last three putts might be less than average).

The skill based gaming event requires one or more physical player actions or inputs. However, the type of skill based gaming event may vary. In one embodiment, the skill-based event may be live, virtual or a combination thereof. For example, the skill based gaming event might comprise hitting a baseball. The player might swing a physical bat and a physical ball in this event. Alternatively, the player might swing a physical bat at a virtually pitched ball, such as one which is shown on a video screen (combination of live/real and virtual). As another example, a player might throw a virtual baseball by simply moving their arm in a pitching motion relative to a plurality of sensors. Thus, the invention can be implemented relative to a wide variety of different skill-based activities or events.

Variances in event difficulty can be introduced in various manners. For example, relative to a golf ball putting event, the distance of the putt to the hole might change. However, in other embodiments, the slope or shape of the putting surface might be changed. Likewise, in a baseball batting contest, the speed or type of pitches might be varied to change the event difficulty. Relative to golf, factors such as tee box location, hole selection, hole location, fairway/rough conditions, hazards (trees, water, sand traps), weather conditions (wind, rain) and a whole host of other factors may determine the difficulty level of the event.

As described, the invention may be implemented in a "player vs. machine" type format, such as where a single player places a wager on the outcome of a skill based event presented via the device and the player's outcome is then evaluated.

Of course, the invention might be applied to other types of wagering configurations. For example, the invention may be applied in a tournament format. For example, 20 players may each place a wager that they won't miss a putt. Each player might putt a golf ball at a hole 5 feet away. Those that miss might be eliminated and the remaining players might then try and putt a golf ball into a hole 10 feet away, and so on, until only one player remains (and may be declared the winner). In configuration, the payout to the winner(s) may be dependent upon the skill levels of the players relative to the defined event and/or the "buy-in" or initial wager which each player must place to participate may vary based upon the players' skill levels (or course, in other embodiments, each player might be required to make a putt of a different distance or difficulty which varies based upon the player's skill level, as described herein).

The invention might also be applied to contests or promotional style events or wagering.

Back-betting may also be facilitated by the methods and systems of the invention. For example, Player A might place a $100 wager that they can sink a 25 foot putt, where the payout for a winning outcome is $150. Bettor B might be permitted to place the same wager on Player A's outcome—e.g. a $100 bet that Player A will be successful (in a preferred embodiment, a back-bettor can only place a bet on another player's successful outcome and not an unsuccessful outcome, such as to prevent collusion between the player and the back-bettor where the player "throws" the outcome to allow the back-bettor to win). Of course, back-betting might be allowed in multi-player events as well. For example, Players A, B and C might each place bets that they can sink a 10 foot, a 25 foot and a 15 foot putt, respectively, Bettor B might place a bet specifically on Player C, betting that Player C will sink their 15 foot putt.

In one embodiment, the player's skill level is used in determining the "pure" odds and payouts for the event. In other embodiments, the player's skill level is partially used to determine the odds and payouts for the event.

Generalized Games

As described above, a player's skill level is utilized in the determination of the odds, payouts or difficulty of the skill-based wagering event. Of course, in some instances, the skill level of the player may not be known or the identity of the player might not be known.

As one example, the first time a player plays a game on a gaming machine or system of the invention, the skill level of the player is not known. As indicated, in one embodiment, the skill level of the player might be preliminarily assessed, such as by having the player provide one or more inputs which are used to provide or set an initial skill level of the player (which skill level may then be re-evaluated, such as based upon later game outcomes).

In another one embodiment, the player's skill level may initially be set at a base level, such as at an "expert" level or the highest level, and may then be adjusted (such as moved downwardly) based upon assessment of a player's actions or inputs. In this configuration, if "expert" level is correlated to the highest level of odds and the lowest payout, the house starts by offering the event in a configuration of lowest risk (e.g. the player is unlikely to be an expert and so they are likely to lose the event; if the player turns out to be an expert, the house only awards the lowest award).

In another embodiment, the first time or times the player plays a skill-based game, the game may be "normalized"—e.g. the game outcome may only be partially dependent upon the skill level of the player. Of course, there are various methodologies for accomplishing such. For example, the gaming machine or system might be configured with one or more random number generators for generating random numbers (such as implemented by a random number generator software module stored in the memory and executable by the processor or controller), such as for use in selecting game outcomes, game level difficulties or the like, for use in presenting the game in a pseudo-random random fashion (e.g. whereby the game is presented in a manner in which the player's input does not solely determine the outcome of the game). As one example, the first time a player plays a batting contest game in which they try and hit a ball, the payouts may be randomly selected, such as based upon the difficulty of the game. For example, if the game selects a 50 mph fastball and the player hits it, the player might be randomly paid a payout of either $10, $25 or $50 on a $25 wager, wherein the weighting of the selected payouts causes, on average, the return to be 97% back to the player and a 3% house hold on wagers in the long term.

Once the skill level of the player is sufficiently ascertained, such as by the player playing the game a number of times, then the player may be offered personalized odds and payouts, such as described above.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting a machine-implemented skill-based game comprising the steps of:

receiving at a game server, from a gaming device configured to present at least one skill-based gaming event, information regarding an identity of a player;

determining, at said game server, a player rating value for said player, the player rating value based upon a skill level of said player, wherein said skill level of said player is identified using said information regarding said identity of said player and is not player selectable;

determining, at said game server, a player multiple from said player rating value;

determining, at said game server, a payout value for a winning outcome of said event, said payout value comprising a base payout value multiplied by said player's player multiple;

transmitting said payout value from said game server to said gaming device;

accepting a wager from said player to participate in said at least one skill-based gaming event;

presenting said at least one skill-based gaming event to said player;

receiving input from said player relative to said skill-based gaming event via one or more input devices;

determining, at said gaming device, an outcome of said at least one skill-based gaming event; and awarding an award to said player in the event of a winning outcome of said at least one skill-based gaming event, a size of said award dependent upon said payout value.

2. The method of claim 1 wherein said player skill level comprises a value which is determined at least in part based upon one or more skill-based inputs by said player as detected by one or more sensors which generate an output which is provided to said game server.

3. The method of claim 1 wherein said player skill level comprises a default value, which default value is later reduced by one or more later player skill feedback inputs.

4. The method of claim 3 wherein said one or more later player skill feedback inputs comprise inputs associated with said player's play of one or more previous skill-based gaming events.

5. The method of claim 1 wherein said player rating value comprises a value on a scale from 1 to 100 and said player multiple comprises a value of 100 divided by the player's player rating value.

6. The method of claim 1 wherein said outcome of said at least one skill-based gaming event is determined at least in part based upon said input from said player.

7. A method of presenting a machine-implemented skill-based game comprising the steps of:

receiving at a game server, from a gaming device configured to present at least one skill-based gaming event, information regarding an identity of a player;

determining, at said game server, a player rating value for said player, the player rating value based upon a skill level of said player;

determining, at said server, a player multiple from said player rating value;

selecting, at said game server, odds for achieving a winning outcome of said at least one skill-based gaming event;

determining, at said game server, a payout value for a winning outcome of said event, said payout value being based upon said odds;

determining, at said game server, a difficultly level for said skill-based gaming event, said difficulty level comprising a value of 1 divided by said player's player multiple;

transmitting said difficultly level and said payout value from said game server to said gaming device;

accepting a wager from said player to participate in said at least one skill-based gaming event;

presenting said at least one skill-based gaming event to said player at said transmitted difficulty level;

receiving input from said player relative to said skill-based gaming event via one or more input devices;

determining, at said gaming device, an outcome of said at least one skill-based gaming event; and awarding an award to said player in the event of a winning outcome of said at least one skill-based gaming event, a size of said award dependent upon said payout.

8. The method of claim 7 wherein said player skill level comprises a value which is determined at least in part based upon one or more skill-based inputs by said player as detected by one or more sensors which generate an output which is provided to said game server.

9. The method of claim 7 wherein said player skill level comprises a default value, which default value is later reduced by one or more later player skill feedback inputs.

10. The method of claim 9 wherein said one or more later player skill feedback inputs comprise inputs associated with said player's play of one or more previous skill-based gaming events.

11. The method of claim 7 wherein said player rating value comprises a value on a scale from 1 to 100 and said player multiple comprises a value of 100 divided by the player's player rating value.

12. The method of claim 7 wherein said outcome of said at least one skill-based gaming event is determined at least in part based upon said input from said player.

13. A system for presenting a skill-based game to a player comprising:

a game server comprising a processor, a memory and a communication interface;

at least one game presentation device, said game presentation device comprising at least one controller, at least one video display and at least one player input device;

machine readable code fixed in a tangible medium and configured to cause said controller of said game presentation device to transmit player identification information to said game server;

machine readable code fixed in a tangible medium and configured to cause said processor of said game server to determine, using said identification information received from said game presentation device, a player multiple, said player multiple determined from a player rating value for said player which is based upon a skill level of said player;

machine readable code fixed in a tangible medium and configured to cause said processor of said game server to determine a payout value for a winning outcome of said event, said payout value comprising a base payout value multiplied by said player's player multiple;

machine readable code fixed in a tangible medium and configured to cause said processor of said game server to transmit said payout value from said game server to said game presentation device;

machine-readable code fixed in a tangible medium and configured to cause said controller of said game presentation device to, upon placement of a wager by said player, present at least one skill-based gaming event to said player, comprising displaying game event information to said player via said at least one video display;

machine-readable code fixed in a tangible medium and configured to cause said controller of said game presentation device to determine an outcome of said at least one skill-based gaming event based at least in part upon input by said player to said at least one player input device; and machine-readable code fixed in a tangible medium and configured to cause said controller of said game presentation device to award an award to said player in the event of a winning outcome of said at least one skill-based gaming event, a size of said award dependent upon said payout value.

14. The system in accordance with claim 13 wherein said game presentation device further comprises at least one monetary value input device for receiving an item having associated monetary value, said controller configured to generate a credit balance in response to the player providing said item having associated value.

15. The system in accordance with claim 13 wherein said at least one player input device comprises at least one of a motion detection device, a button and a touch-screen.

16. The system in accordance with claim 13 wherein said difficulty level of said event is determined by a selection by said player.

17. The system in accordance with claim 13 further comprising machine-readable code fixed in a tangible medium and configured to cause said controller of said game presentation device to transmit information to said game server regarding said player's performance relative to said skill-based gaming event and machine-readable code fixed in a tangible medium and configured to cause said processor of said game server to modify said player skill level based upon said information.

18. The system in accordance with claim 13 wherein said player rating value comprises a value from 1 to 100 and said player multiple comprises a value of 100 divided by the player's player rating value and said player rating value is stored in association with said player identification information.

19. The system in accordance with claim 13 wherein said processor determines said player multiple from said identification information by utilizing said identification information to look up said player's player multiple from a database of player records, each record identifiable using player identification information and having a player multiple associated therewith.

20. The system in accordance with claim 19 wherein said player multiples comprise values between 1 and 100.

* * * * *